US008998028B2

(12) United States Patent
Ramsey et al.

(10) Patent No.: US 8,998,028 B2
(45) Date of Patent: Apr. 7, 2015

(54) CAN END WITH FILM INSERT

(75) Inventors: Christopher Paul Ramsey, Wantage (GB); Sylvia Maria Farrow, Wantage (GB); Eleanor Rachel Ann Hyde, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/514,462

(22) PCT Filed: Dec. 9, 2010

(86) PCT No.: PCT/EP2010/069267

§ 371 (c)(1), (2), (4) Date: Aug. 7, 2012

(87) PCT Pub. No.: WO2011/070107

PCT Pub. Date: Jun. 16, 2011

(65) Prior Publication Data

US 2012/0312815 A1 Dec. 13, 2012

(30) Foreign Application Priority Data

Dec. 9, 2009 (GB) ..... 0921551.8

(51) Int. Cl.
*B65D 51/00* (2006.01)
*B65D 17/00* (2006.01)

(52) U.S. Cl.
CPC ..... *B65D 17/165* (2013.01); *B65D 2517/0014* (2013.01); *B65D 2517/0052* (2013.01); *B65D 2517/0062* (2013.01); *Y10S 220/906* (2013.01)

(58) Field of Classification Search
USPC ..... 220/212, 703, 731, 257.2, 259.4, 906; 40/307; 206/459.1
See application file for complete search history.

(56) References Cited

U.S. PATENT DOCUMENTS

| | | | | | |
|---|---|---|---|---|---|
| 4,363,179 | A * | 12/1982 | Ruemer et al. | 40/307 |
| 4,559,729 | A * | 12/1985 | White | 40/306 |
| 5,096,082 | A * | 3/1992 | Hoefler | 220/257.1 |
| 5,316,166 | A * | 5/1994 | Pavely et al. | 220/269 |
| 5,775,534 | A * | 7/1998 | Webb et al. | 220/269 |
| 5,845,801 | A * | 12/1998 | Heitl | 220/269 |
| 6,386,814 | B2 * | 5/2002 | Song | 413/14 |
| 7,198,168 | B2 * | 4/2007 | Mizuma | 220/269 |
| 2007/0145055 | A1 * | 6/2007 | Gardiner | 220/254.4 |
| 2008/0197618 | A1 * | 8/2008 | Ronnberg | 283/67 |
| 2008/0272120 | A1 * | 11/2008 | Delport et al. | 220/269 |
| 2009/0057314 | A1 * | 3/2009 | Webb | 220/257.1 |

FOREIGN PATENT DOCUMENTS

| | | |
|---|---|---|
| EP | 0482776 | 4/1992 |
| EP | 1218248 | 2/2002 |
| EP | 1967456 | 9/2008 |
| WO | WO 01/68460 | 9/2001 |

* cited by examiner

*Primary Examiner* — Fenn Mathew
*Assistant Examiner* — Robert Stodola
(74) *Attorney, Agent, or Firm* — Baker & Hostetler LLP

(57) ABSTRACT

A container end (20) having a dispensing aperture (50) with a closed position, in which the dispensing aperture is sealed, and an open position, in which product may be dispensed through the aperture (50). The end (20) includes a flexible film (70), which has at least one tongue (75) anchored to the end (20) outside the periphery of the aperture (50) and having a free end, which is visible in the dispensing aperture once the aperture is opened. The free end of the tongue (75) is concealed when the aperture (50) is closed, but becomes visible to a user once the aperture (50) is opened.

11 Claims, 5 Drawing Sheets

PRIOR ART

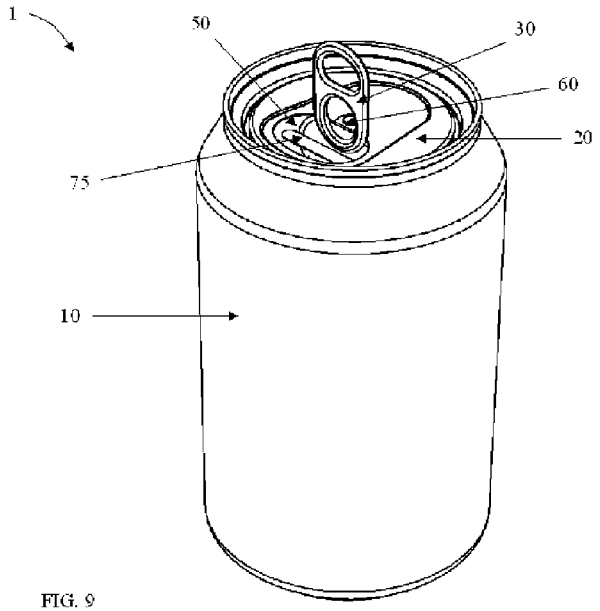
FIG. 9
FIG. 10A
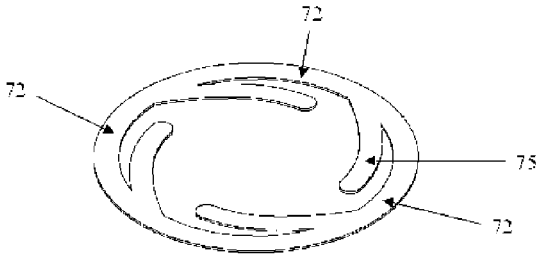
FIG. 10B
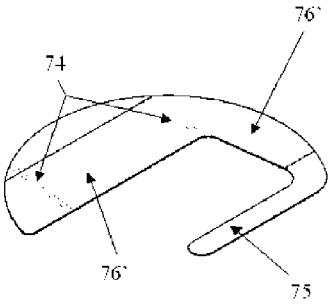
FIG. 10C
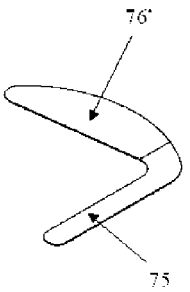

CAN END WITH FILM INSERT

CROSS-REFERENCE TO RELATED APPLICATIONS

This application is the National Stage of International Application No. PCT/EP2010/069267, filed Dec. 9, 2010, which claims the benefit of EP application number 0921551.8, filed Dec. 9, 2009, the disclosures of which are incorporated herein by reference in their entirety.

TECHNICAL FIELD

The present invention provides a film insert, which may be applied to a conventional beverage can end. Upon opening the can, a portion of the film insert is exposed and is suitable for promotional activities.

BACKGROUND ART

EP 0482776 A (CMB FOODCAN PLC.) 29.04.1992 describes prior art in which detachable pull ring can ends had a printed underside and were used for gaming purposes in America. However, over time, detachable pull ring ends were banned due to litter and environmental concerns.

U.S. Pat. No. 4,363,179 A (CROWN CORK & SEAL COMPANY, INC.) 14.12.1982 describes a beverage can end with retained-tab having concealed promotional material printed beneath the tab. This document describes how promotional material is printed on the surface of the can end under the tab around the rivet holding the tab to the can end. According to this document, it is impossible to view the promotional material without opening the can. However, the location and size of this printed, promotional material may result in it being difficult to read by a user of the beverage can.

EP 0482776 A (CMB FOODCAN PLC.) 29.04.1992 describes an alternative arrangement, in which the ring pull has an aperture adapted to retain a token. This document describes how the token may be removed by a user of the can to either act as proof of purchase or to qualify the user for a prize or other premium offer. However, the "token" described in this document may be considered to give rise to similar litter and environmental concerns as those raised previously with regard to detachable ring pulls.

Finally, EP 1218248 B (JOSEPH STASIUK) 03.02.2002 describes laser-etched pull-tabs and a methods for making the same. Laser-etching is described as an effective and cost efficient means of providing container opening devices having high definition and permanent indicia for promotional and other purposes.

As shown above, several beverage can ends are described in the prior art in which the tab used for opening the end or its location on the can end is marked in some way and provides an opportunity for promotional activities, for example awarding prizes and the like.

SUMMARY OF INVENTION

The present invention provides an alternative end construction for providing an award of prizes or other promotional activities. Accordingly, the invention provides a container end defining an aperture having a closed position in which the aperture is sealed and an open position in which product may be dispensed through the aperture, characterised in that the container end includes a flexible film fixed outside the periphery of the aperture and the flexible film defines at least one tongue having an anchored end and a free end, the free end extending into the aperture.

The alternative end construction according to the invention allows promotional activities to be achieved on a wide range of container ends. The end merely requires a dispensing aperture, where a tongue or flag can be located. The dispensing aperture requires a closed position where the tongue or flag is occluded (not visible) and an open position where the tongue or flag is visible within the aperture. A tab is not necessary. For example, the invention may be applied to peelable membrane ends, ends with apertures covered by a tear off strip, container carton bricks having defined dispensing apertures with some form of closure or cartons having a separate plastic end component, in which a score defines the periphery of a dispensing aperture.

The flexible film used in the end according to the invention may be adhered to an internal surface of the end, so that it is concealed from a user of the end until the aperture is opened and the film tongue is visible in the aperture.

The flexible film may include a plurality of tongues arranged so that one tongue aligns with the aperture and upon opening may be viewed by a user of the container to which the end is affixed. This arrangement is advantageous, because the flexible film/shaped tongue does not need to be aligned on the end.

Such a flexible film may be provided on an end having a score, which severs upon opening by a user to provide the aperture. The score defines an aperture panel, which may be pushed into the inside of the container after opening e.g. a conventional beverage end. The aperture panel pushes past the flexible tongue, which is designed to bend to allow the aperture panel to pass and then returns to its original position once the aperture has been opened (extending into the aperture). The inventors have found that the flexible tongue has only a small effect on the flow rate from the container as the product in the container is dispensed. This is because the tongue flexes outwardly under the action of product being dispensed. The shape and location of the tongue may be designed to enhance the ability of the tongue to flex.

Preferably, the flexible tongue is shaped to follow the periphery of the dispensing aperture. This has the advantage that as product is dispensed from the container, the tongue is naturally pushed out of the way in reaction to the flow of the product and does not form a significant flow restriction or choking hazard if a user drinks directly from the container.

BRIEF DESCRIPTION OF DRAWINGS

The present invention will now be described, by way of example only, with reference to the accompanying drawings, in which:

FIG. 9 shows an external view of an opened beverage can according to the present invention; and FIGS. 10A to 10C illustrate various configurations of flexible film suitable for use in the present invention (FIG. 10A illustrates a suitable film configuration for use in the first embodiment of the invention, FIG. 10B illustrates a suitable film configuration for use in the second embodiment of the invention and FIG. 10C illustrates a suitable film configuration for use in the third embodiment of the invention.)

FIG. 1 illustrates the external appearance of a conventional beverage can 1 having a can body 10 sealed by a lid 20. The lid 20 is provided with a score 40, which defines an aperture (not shown). Rupture of the score 40 is initiated by lifting a tab 30, which is fixed to the end 20 by a rivet 60. The external appearance of the beverage can 1 is unchanged by the invention.

FIG. 2 illustrates the internal facing side of the lid 20 (also referred to as a "can end" 20) and illustrates the position of the score 40 and rivet 60. FIG. 2 is provided for reference only and is altered in the invention.

Figure 1:
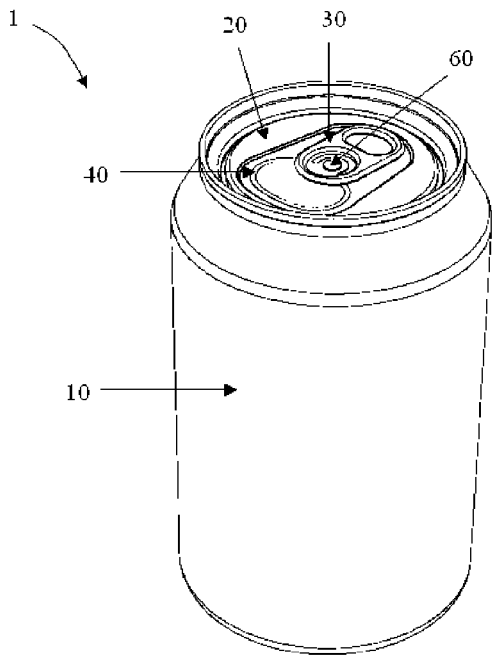
FIG. 1 PRIOR ART
FIG. 1 shows the external appearance of a closed (and sealed) beverage can, which is both conventional in the prior art and is also applicable to the present invention.
Figure 2:
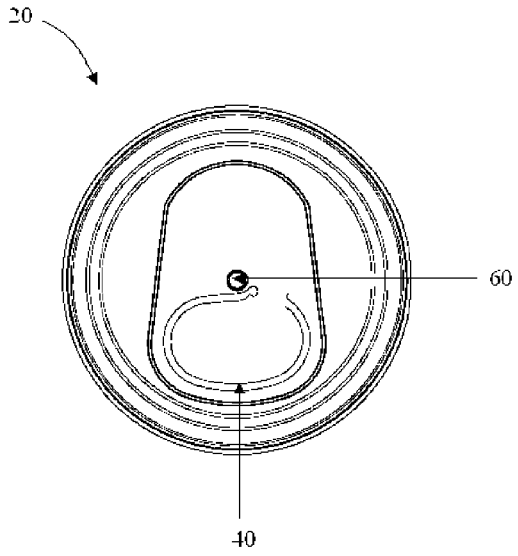
FIG. 2 shows the underside of a conventional beverage can end used in the prior art and adapted for use in the present invention.
Figure 3:
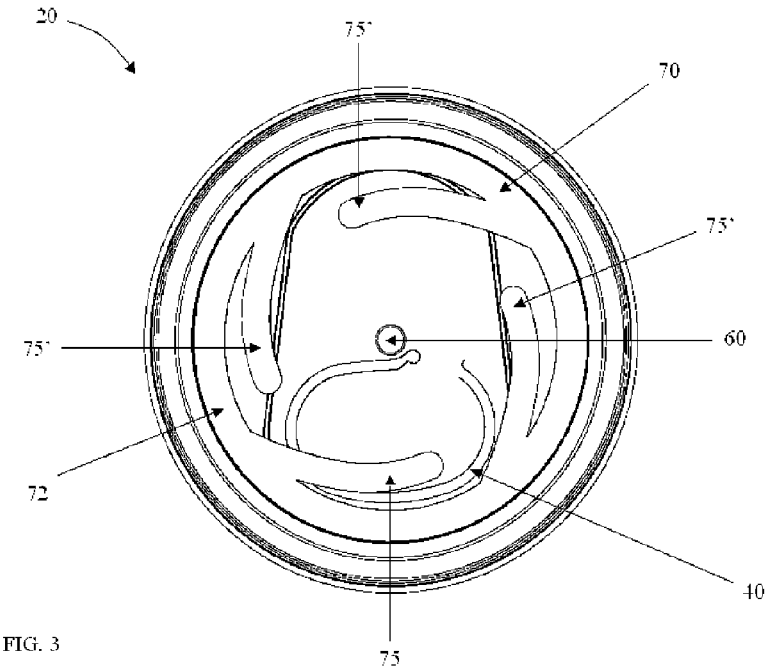
FIG. 3 shows the beverage end as shown in FIG. 2, adapted according to a first embodiment of the invention by provision of a non-orientated flexible film having a plurality of flexible tongues, one of which aligns with the aperture panel.

A first embodiment of the invention is shown in FIG. 3. According to the invention, a flexible film 70 is applied to the internal surface of the conventional lid or end 20 illustrated in FIG. 2. The flexible film 70 defines a plurality of tongues 75, 75', one of which (tongue 75) aligns with the aperture (not labelled) located within the periphery of the score 40. The arrangement according to the invention has the advantage that before opening, the tongue is not visible on the external surface of the beverage can 1 (as shown in FIG. 1). As in a conventional beverage can, the aperture is opened by a user lifting the tab 30, which presses close to the score 40 initiating rupture of the score 40.

The tongue 75 has an anchor 72, which is outside the aperture area circumscribed by the score 40. The anchor 72 provides an area for adhesive to fix the flexible film 70 to the underside of the lid or end 20. The non-operative tongues 75' are concealed by the underside of the lid or end 20 not opened by the aperture. The advantage of this first embodiment is that the flexible film 70 and tongues 75, 75' are arranged so that only one tongue 75 aligns with the aperture defined within the score 40 and alignment of the flexible film 70 with the underside of the lid or end 20 is not required.

Figure 4:
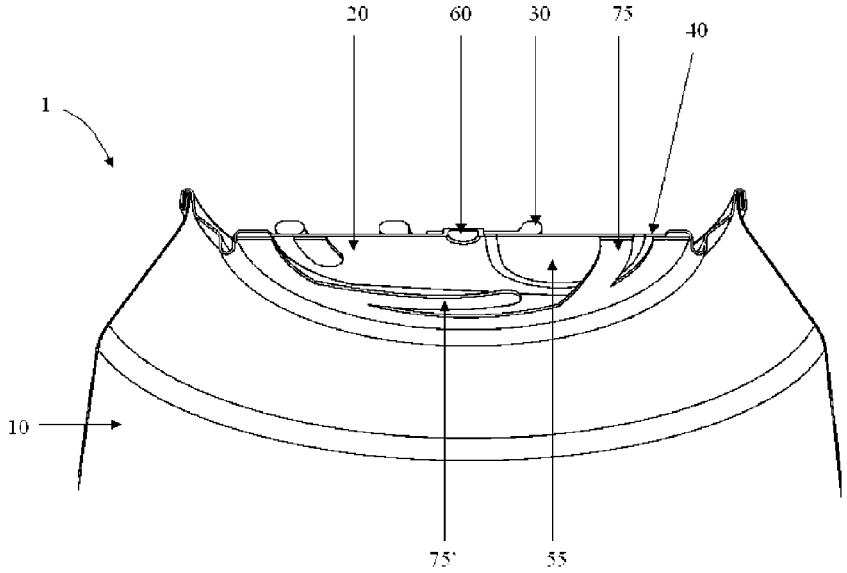
FIG. 4 is a side view of the container end shown in FIG. 3 affixed to a beverage can body with the aperture in its closed and sealed configuration.
Figure 5:
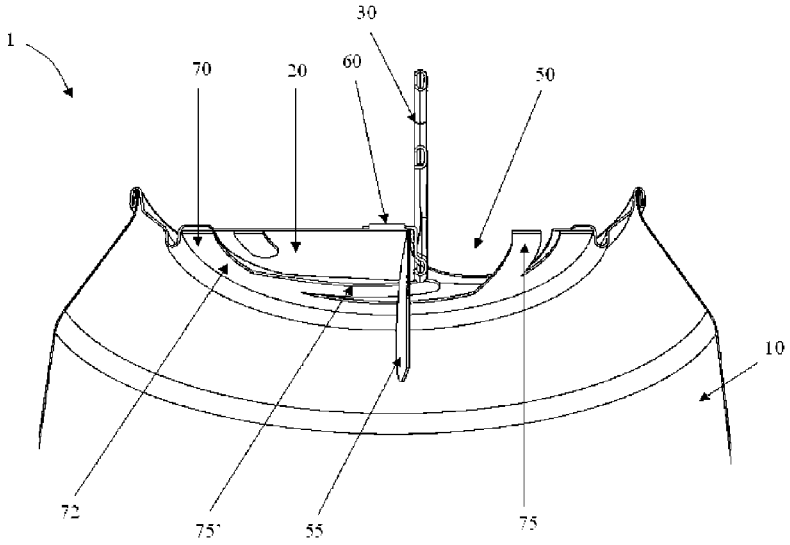
FIG. 5 is a side view of the container end shown in FIG. 3 affixed to a beverage can body with the aperture in its opened configuration.

FIGS. 4 and 5 illustrate the beverage can 1, comprising body 10 and lid or end 20, in a closed (and sealed) configuration and open configuration respectively. Referring to FIG. 4, a beverage can body 10 is filled with product (not shown) and then sealed by a lid or end 20 in a conventional manner. The lid or end 20 includes a score 40, which is arranged around the periphery of an aperture panel 55, as conventional and a tab 30 is fixed to the lid or end 20 by a rivet 60. In a prize-winning can, a flexible film is attached to the inward facing surface of the lid or end 20. As illustrated in FIG. 3, the flexible film defines a plurality of tongues 75, 75', one of which is positioned under the aperture panel 55. The tongue 75 aligned with the aperture panel is adapted to be visible to a user of the can upon opening. The remaining, non-operative tongues 75' are hidden beneath the remainder of the lid or end 20.

As illustrated in FIG. 5, upon opening a user lifts the tab 30, which severs the score (not referenced), presses the aperture panel 55 inside the can body 10 and exposes the aperture 50. In a prize-winning can, the flexible tongue 75 is bent out of the way by the aperture panel 55, which is allowed to pass. After opening, the tongue 75 returns to its original position and thereafter is visible to a user within the aperture 50. As the user pours product (not shown) from the can, the tongue may flex outwardly and has been found to allow an adequate flow rate of product from the beverage can 1.

Figure 6:
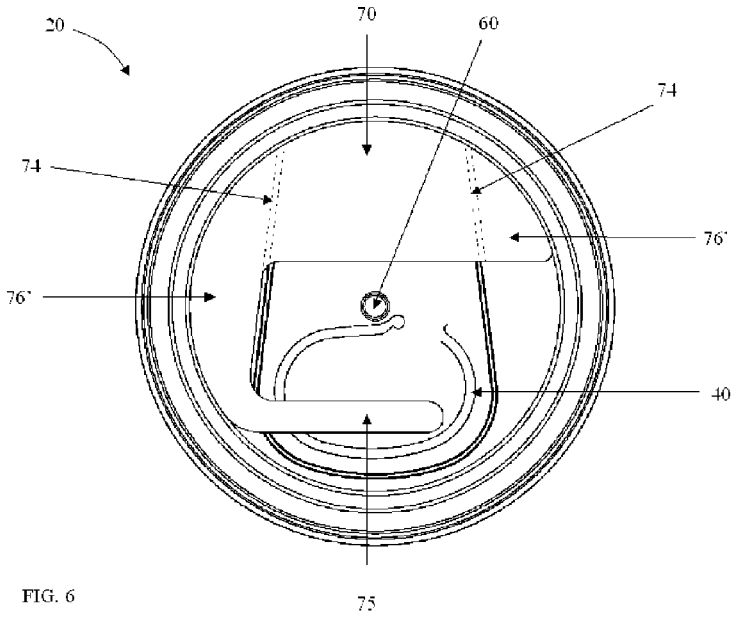
FIG. 6 shows the beverage end as shown in FIG. 2, adapted according to a second embodiment of the invention by provision of an orientated flexible film having one flexible tongue aligned with the aperture panel and fold lines to enable the flexible film to more closely follow the contours of the underside of the beverage can end.

FIG. 6 illustrates a second embodiment of the invention having only one tongue 75. This embodiment requires the flexible film 70 to be aligned on the underside of the lid or end 20, but this is considered acceptable where only a small number of prize-winning ends 20 are envisaged. Additionally, the ability of the film to conform to surface features on the underside of the lid or end 20 may be enhanced by provision of scored lines 74. This second embodiment of the invention has the advantage that the area available for adhesive to anchor 72 the film 70 the underside of the end 20 is greatly increased. It is important that adhesive is only applied to the anchor 72 area of the film and not to the tongue 75. Therefore, the film is "pattern coated" with adhesive 76' in the anchor 72 areas and remains uncoated on the tongue 75.

As the flexible film 70 used in the present invention is located on the "product side" of any lid or end 20, the materials used in the construction of the end or lid 20 have to comply with "food contact" regulations in the country in which the end is sold. For this reason, "food contact" approved materials (including adhesives) are preferred. Many adhesives are approved for edge only contact with foods and in this case, the edge of the adhesive must be fully stuck down. If the anchor 72 has some unstuck areas, this is not acceptable. Thus, in some circumstances the scored lines 74 (discussed above) will be unacceptable.

Figure 7:
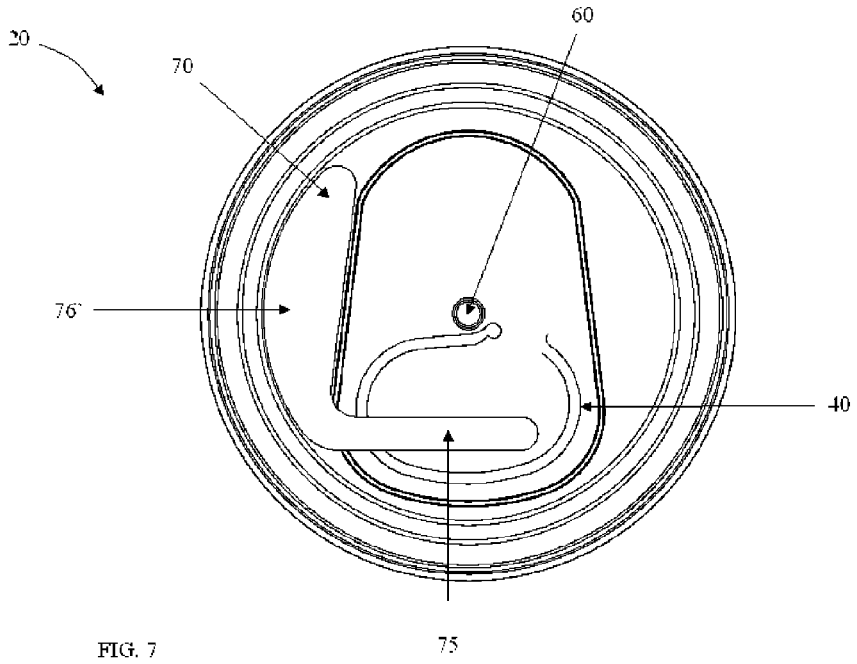
FIG. 7 shows the beverage end as shown in FIG. 2, adapted according to a third embodiment of the invention by provision of an orientated flexible film having one flexible tongue aligned with the aperture panel and a non-interrupted adhesive area.

FIG. 7 illustrates a third embodiment of the invention, similar to that shown in FIG. 6, but where the "pattern coated" area (anchor 72) is located within the substantially flat area of the underside of the lid or end 20, so that no scored lines are needed (cf. "scored lines 74" in FIG. 6).

Figure 8:
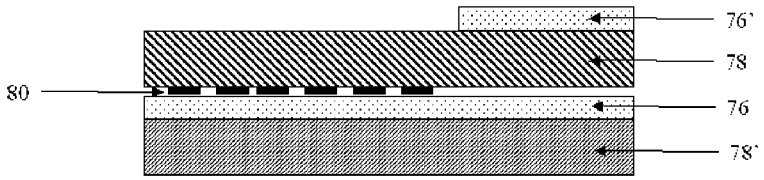
FIG. 8 gives an example of the structure of a laminated, flexible film suitable for use in the present invention.

The inventors have proposed a laminate structure for the flexible film 70 and a suitable structure is shown in FIG. 8. Preferably, the laminate structure comprises at least two layers of PET 78, 78' joined together by a layer of adhesive 76 during the lamination stage. Preferable a code or symbol is provided on the tongue 75 and any ink or material 80 used to form the code or symbol is encapsulated between the layers of PET 78, 78'. Preferably, the ink or material 80 is spaced at least 0.7 mm from the edge of the tongue 75 so that it is fully sealed within the laminate and avoids any "food contact" issues. The upper layer or layers of the laminate 78 (facing the user, when the can is opened) are translucent to allow the user to see the ink or symbol 80. Preferably, the upper layer or layers of the laminate 78 are transparent. The lower layer or layers 78' of the laminate (facing the inside of the beverage can 1) are chosen from a contrasting colour to the ink or symbol 80 to enhance the visual effect for the user. The anchor portion of the flexible film 70 is pattern coated with adhesive 76' to adhere the flexible film 70 to the end or lid 20 as previously described.

FIG. 9 illustrates an opened beverage can 1 according to the invention having a body 10, an end or lid 20 and a tab 30 to expose the aperture 50 and the tongue 75 (where a prize-winning can). FIG. 9 illustrates the opened beverage can 1 for the first, second and third embodiments of the invention.

Finally, FIG. 10 shows the flexible film 70 according to the first embodiment (FIG. 10A), the second embodiment (FIG. 10B) and the third embodiment (FIG. 10C) of the invention. In each embodiment, the flexible film 70 includes an area for adhesive 72, 76' and a tongue 75.

The flexible film successfully used by the inventors in the embodiments described above is white PET, 75 microns thick with a 6-point text height printed on the tongue 75 in black ink.

The person skilled in the art will understand that the tongue part of the flexible film must be free and extend into the aperture created in the can end, whilst the anchor needs to be fixed to the can end. The tongue may be arranged to extend at any angle including circumferentially, as shown in the drawings or radially from the rivet or the edge of the aperture. Except, in a known "stay-on-tab" style end, the location must be chosen to ensure that the hinge between the aperture panel and the remainder of the end or lid does not impede the flexible tongue.

The invention claimed is:

1. A container end comprising: a center panel and a wall outside of the center panel adapted for being seamed to a can body, the center panel and wall defining an internal surface and an external surface; an aperture formed in the center panel and configured to have a closed position in which the aperture is sealed and a fully open position in which product may be dispensed through the aperture; a flexible film fixed to the internal surface of the end outside the periphery of the aperture, and the flexible film defining at least one flexible tongue having an anchored end and a free end, the free end having a distal edge extending under the aperture and terminating directly under the aperture while the aperture is in the fully open position; wherein the distal edge of the free end of the tongue is concealed when the aperture is in the closed position.

2. The container end according to claim 1, wherein the flexible film provides a plurality of tongues spaced around the aperture and shaped to ensure that at least one tongue has the distal edge of the free end that extends under the aperture and terminates directly under the aperture.

3. The container end according to claim 1 further comprising a tab coupled to the center panel and a score defining an aperture panel such that upon opening the tab is arranged to sever the score and move the aperture panel out of the aperture.

4. The container end according to claim 3, wherein the tab is adapted to push the aperture panel inside the container past the flexible tongue.

5. The container end according to claim 1, wherein the tongue provides a prize code or symbol from which the user can determine what prize has been won.

6. A flexible film for use on a container end, the film comprising an anchored end configured to be attached to be an interior side of the end and a free end having a distal edge configured to extend under an aperture in the can end and to terminate directly under the aperture while the aperture is in the fully open position.

7. The container end according to claim 1 wherein the flexible tongue includes indicia adapted to be visible when the aperture is in its open position.

8. A container comprising a body for holding a product and a container end that comprises: a center panel and a wall outside of the center panel, a portion of the wall being attached to the body by a seam, the center panel and wall defining an internal surface and an external surface; an aperture formed in the center panel and configured to have a closed position in which the aperture is sealed and an open position in which product may be dispensed through the aperture, the aperture being at least partly coextensive with an aperture panel; and a flexible film fixed to the internal surface of the end outside the periphery of the aperture, and the flexible film defining at least one flexible tongue having an anchored end and a free end, the free end having a distal edge extending into under the aperture and terminating directly under the aperture while the aperture is in the fully open position; wherein the distal edge of the free end of the tongue is concealed when the aperture is in the closed position.

9. The container end of claim 8 wherein the distal edge of the free end of the film is configured to be visible when the aperture is in the fully open position.

10. The container according to claim 8, wherein the body is a beverage can body and the end is a beverage can end having a score to define the aperture panel and a tab, and wherein upon opening, the tab is configured to sever the score to reveal the aperture and the tongue.

11. The container end of claim 1 wherein the distal edge of the free end of the film is configured to be visible when the aperture is in the fully open position.

* * * * *